US007899389B2

(12) United States Patent
Mangum

(10) Patent No.: US 7,899,389 B2
(45) Date of Patent: Mar. 1, 2011

(54) METHODS, DEVICES, AND COMPUTER PROGRAM PRODUCTS FOR PROVIDING A KARAOKE SERVICE USING A MOBILE TERMINAL

(75) Inventor: Peter Marshall Mangum, Raleigh, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 1149 days.

(21) Appl. No.: 11/227,465

(22) Filed: Sep. 15, 2005

(65) Prior Publication Data

US 2007/0065794 A1 Mar. 22, 2007

(51) Int. Cl.
*A63J 5/10* (2006.01)

(52) U.S. Cl. ..... 434/307 A; 434/307 R

(58) Field of Classification Search ..... 463/30–43; 273/430–432, 453; 434/308–321, 307 A, 434/307 R See application file for complete search history.

(56) References Cited

U.S. PATENT DOCUMENTS

| | | | | |
|---|---|---|---|---|
| 5,631,433 | A * | 5/1997 | Iida et al. | 84/610 |
| 5,689,081 | A * | 11/1997 | Tsurumi | 84/609 |
| 5,833,469 | A * | 11/1998 | Ito et al. | 434/307 A |
| 6,083,009 | A * | 7/2000 | Kim et al. | 434/307 A |
| 6,418,421 | B1 * | 7/2002 | Hurtado et al. | 705/54 |
| 6,520,776 | B1 * | 2/2003 | Furukawa | 434/307 A |
| 6,763,384 | B1 * | 7/2004 | Gupta et al. | 709/224 |
| 2002/0062236 | A1 * | 5/2002 | Murashita et al. | 705/5 |
| 2004/0162062 | A1 | 8/2004 | Lee | |
| 2005/0106546 | A1 | 5/2005 | Strom | |

FOREIGN PATENT DOCUMENTS

| | | | |
|---|---|---|---|
| FR | 2803422 A1 | | 7/2001 |
| JP | 2001045116 | | 2/2001 |
| JP | 2002169575 A | * | 6/2002 |
| JP | 2002278572 | | 9/2002 |
| JP | 2003005767 | | 1/2003 |
| JP | 2005017736 A | * | 1/2005 |
| JP | 2005078057 A | * | 3/2005 |

OTHER PUBLICATIONS

Notification of Transmittal of the International Search Report and the Written Opinion of the International Searching Authority, or the Declaration corresponding to PCT/US2006/018887 mailed on Nov. 29, 2006.

* cited by examiner

*Primary Examiner*—James S McClellan
*Assistant Examiner*—Allen Chan
(74) *Attorney, Agent, or Firm*—Myers Bigel Sibley & Sajovec

(57) ABSTRACT

A karaoke service is provided responsive to receiving a plurality of performance requests associated with a plurality of mobile terminals. The plurality of performance requests are queued in a selected order to provide a karaoke performance schedule, and a next performance request is identified based on the karaoke performance schedule. An end time of a current karaoke performance is determined, and a notification is transmitted to at least one of the plurality of mobile terminals associated with the next performance request over a wireless connection at a predetermined time based on the determined end time. Audio data is received from the at least one mobile terminal associated with the next performance request over a wireless connection responsive to transmitting the notification thereto. The received audio data is provided to audio equipment for output.

25 Claims, 6 Drawing Sheets

METHODS, DEVICES, AND COMPUTER PROGRAM PRODUCTS FOR PROVIDING A KARAOKE SERVICE USING A MOBILE TERMINAL

FIELD OF THE INVENTION

The present invention relates to the field of wireless communications, and more particularly, to methods of providing wireless communication services using mobile terminals and related devices.

BACKGROUND OF THE INVENTION

The idea of karaoke, or 'sing-along', is that a performer can sing along with pre-recorded music in such a way that the performer and/or an audience can listen to the voice of the performer in combination with the pre-recorded music. For example, a conventional karaoke machine may include a microphone connected thereto, a music player capable of playing the pre-recorded music with the vocal tracks removed, and a video screen or other display for displaying the text/lyrics corresponding to the pre-recorded music synchronized with the music. A performer may thereby read/sing the displayed lyrics into the microphone to provide the vocal part of the song being played, which may be mixed with the pre-recorded music and/or amplified at the karaoke machine and broadcast to the audience.

Karaoke may be popular in restaurants, bars, and/or nightclub settings, where a large audience may be present. In such karaoke establishments, a DJ (disc jockey) may manage the karaoke machine. The DJ may have a list of karaoke selections available in a song library. Audience members may review the list and decide on songs they want to perform. To request a song, an audience member may write a song selection on a piece of paper and pass it to the DJ. The DJ may cue the songs from the song library and announce the next performer based on the requests received via the pieces of paper.

However, it may be difficult for the DJ to keep track of the order of receipt of requests using such a paper-based system. As such, requests may be queued out of order, which may upset and/or otherwise dissatisfy potential karaoke performers. Furthermore, after calling the next performer, the DJ (and the audience) must wait for the performer to make his way through the audience, walk to the DJ/staging area, and physically retrieve the microphone from a previous performer. Such a process may be time-consuming, which may lead to audience dissatisfaction and/or boredom.

In addition, only one or two microphones may be available in a typical karaoke setting. As such, performers who wish to perform songs in a group may have to share a common microphone, which may be inconvenient. Moreover, some performers may enjoy karaoke, but may not wish to stand on stage in front of a large audience. For example, some potential performers may wish to sing, but may feel, shy, nervous, and/or otherwise awkward about performing for a large number of people. Accordingly, it may be convenient for performers to be able to perform karaoke from their current location in the karaoke establishment, such as from a table at which they are currently seated.

SUMMARY OF THE INVENTION

According to some embodiments of the present invention, methods of providing a karaoke service may include receiving a plurality of performance requests associated with a plurality of mobile terminals. The plurality of performance requests may be queued in a selected order to provide a karaoke performance schedule, and a next performance request may be identified based on the karaoke performance schedule. An end time of a current karaoke performance may be determined, and a notification may be transmitted to at least one of the plurality of mobile terminals associated with the next performance request over a wireless connection. The notification may be transmitted at a predetermined time based on the determined end time. Audio data may be received from the mobile terminal or terminals associated with the next performance request over a wireless connection responsive to transmitting the notification thereto, and the received audio data may be provided to audio equipment for output.

In some embodiments of the present invention, the received audio data may be first audio data. The method may further include retrieving second audio data associated with the first audio data from a database, and mixing the first audio data and the second audio data. The mixed audio data may be provided to audio equipment for output.

In other embodiments of the present invention, the first audio data may be voice data received via a microphone of the mobile terminal associated with the next performance request. The database may be a song database, and the second audio data may be instrumental music data corresponding to a song specified in the next performance request and retrieved from the song database. In addition, lyric data corresponding to the song specified in the next performance request may be retrieved from the song database and may be transmitted to a display of the mobile terminal associated with the next performance request.

In some embodiments of the present invention, the karaoke server may receive and queue plurality of performance requests. Also, the karaoke server may identify the next performance request, determine the end time of the current performance, transmit the notification, and receive the audio data. The audio data may be voice data, and the karaoke server may provide the voice data to a karaoke machine.

In other embodiments of the present invention, at least a portion of the karaoke performance schedule may be transmitted to at least one of the plurality of mobile terminals responsive to receiving a performance request associated therewith.

In some embodiments of the present invention, a performance schedule query may be received from a mobile terminal, and at least a portion of the karaoke performance schedule may be transmitted to the querying mobile terminal responsive to receiving the performance schedule query.

In other embodiments of the present invention, a song database query may be received from a mobile terminal, and a list of song library information may be transmitted to the querying mobile terminal responsive to receiving the song database query.

In some embodiments of the present invention, the plurality of performance requests may be queued based on an order of receipt thereof to provide the karaoke performance schedule. In addition, the plurality of performance requests may be queued based on respective priority data associated with the plurality of mobile terminals to provide the karaoke performance schedule.

In other embodiments of the present invention, a plurality of manually entered performance requests that are not associated with the plurality of mobile terminals may be received. The plurality of manually entered performance requests and the plurality of performance requests associated with the mobile terminals may be queued together in a selected order to provide the karaoke performance schedule.

In some embodiments of the present invention, the next performance request may be rescheduled in the performance schedule if audio data is not received from the mobile terminal associated with the next performance request responsive to transmitting the notification thereto.

In some embodiments of the present invention, the received plurality of performance requests may be assigned to respective designated timeslots in the karaoke performance schedule. As such, the notification may be transmitted to the mobile terminal associated with the next performance request at a predetermined time based on a designated timeslot associated with the performance request. In addition, the audio data may be received from the mobile terminal associated with the next performance request during the designated timeslot.

In other embodiments of the present invention, a user request to perform karaoke may be received at a user interface associated with one of the plurality of mobile terminals. The user request may be formatted at the mobile terminal associated with the user interface to provide a performance request. The performance request may be configured to be queued at a karaoke server. The performance request may be transmitted from the mobile terminal associated with the user interface to the karaoke server over a wireless connection. In response, the notification may be received at the mobile terminal associated with the user interface from the karaoke server over a wireless connection at the predetermined time based on the end time of the current performance. Responsive to receiving the notification, audio data may be transmitted from the mobile terminal associated with the user interface to the karaoke server over a wireless connection.

According to further embodiments of the present invention, a method of operating a mobile terminal to provide a karaoke service may include receiving a user request to perform karaoke for a specified song from a user interface of the mobile terminal. The user request may be formatted to provide a performance request that is configured to be queued at a karaoke server. The performance request may be transmitted to the karaoke server over a first wireless connection. A notification from the karaoke server may be received over a second wireless connection at a predetermined time based on an end time of a current karaoke performance. Responsive to receiving the notification, audio data may be transmitted to the karaoke server over a third wireless connection.

In some embodiments of the present invention, the first, second, and/or third wireless connection may be provided over an ad hoc wireless network, and the audio data may be voice data. More specifically, voice data corresponding to the specified song may be received via a microphone of the mobile terminal, and the received voice data may be transmitted to the karaoke server over the third wireless connection.

In other embodiments of the present invention, lyric data corresponding to the specified song may be received from the karaoke server over the wireless connection and displayed on a display of the mobile terminal.

In some embodiments of the present invention, a user request to view the performance schedule may be received from the user interface, and a performance schedule query may be transmitted to the karaoke server based on the user request. Responsive to transmitting the performance schedule query, at least a portion of the karaoke performance schedule may be received from the karaoke server and displayed on a display of the mobile terminal.

In some embodiments of the present invention, a user request to view a list song library information may be received from the user interface, and a song database query may be transmitted to the karaoke server based on the user request. Responsive to transmitting the song database query, the list of song library information may be received from the karaoke server and displayed on a display of the mobile terminal.

In other embodiments of the present invention, the first, second, and/or third wireless connections may be a same wireless connection.

According to still further embodiments of the present invention, a method of providing a karaoke service may include receiving first audio data at a karaoke server from a mobile terminal. Second audio data associated with the first audio data may be retrieved from a database associated with the karaoke server. The first audio data and the second audio data may be mixed at the karaoke server and transmitted to a speaker for output.

In some embodiments of the present invention, the first audio data may be voice data received via a microphone associated with the mobile terminal. The database may be a song database, and the second audio data may be instrumental music data retrieved from the song database. In addition, lyric data corresponding to the instrumental music data may be retrieved from the song database and transmitted to a display of the mobile terminal.

According to other embodiments of the present invention, a karaoke server may include an interface configured to receive a plurality of performance requests associated with a plurality of mobile terminals, and a transceiver configured to establish wireless connections with the plurality of mobile terminals. The karaoke server may further include a controller coupled to the interface and the transceiver. The controller may be configured to queue the received plurality of performance requests in a selected order to provide a karaoke performance schedule, identify a next performance request based on the karaoke performance schedule, and determine an end time of a current karaoke performance. The controller may also be configured to provide a notification to a mobile terminal associated with the next performance request over a wireless connection at a predetermined time based on the determined end time, receive audio data from the mobile terminal over a wireless connection responsive to transmission of the notification, and provide the received audio data to audio equipment for output.

In some embodiments of the present invention, the karaoke server may further include a database coupled to the controller. The received audio data may be first audio data, and the database may be configured to store second audio data associated with the first audio data. The karaoke server may further include an audio processor coupled to the controller. As such, the controller may be configured to retrieve the second audio data from the database and provide the first and second audio data to the audio processor. The audio processor may be configured to mix the first audio data and the second audio data and provide the mixed audio data to a speaker for output.

In other embodiments of the present invention, the first audio data may be voice data received via a microphone of the mobile terminal associated with the next performance request, the database may be a song database, and the second audio data may be instrumental music data corresponding to a song specified in the performance request. The controller may be further configured to retrieve lyric data corresponding to the song specified in the performance request from the song database and provide the lyric data to a display of the mobile terminal associated with the next performance request.

In some embodiments of the present invention, the karaoke server may also include an external karaoke machine interface coupled to the controller. The external karaoke machine interface may be configured to provide the received voice data to an external karaoke machine. Also, the external karaoke machine interface may be configured to receive a plurality of manually entered performance requests. The controller may be configured to queue the plurality of manually entered performance requests and the plurality of performance requests from the mobile terminals in a selected order to provide the karaoke performance schedule.

In other embodiments of the present invention, the controller may be configured to queue the plurality of performance requests based on an order of receipt thereof and/or based on respective associated priority data to provide the karaoke performance schedule.

According to still other embodiments of the present invention, a mobile terminal may include a user interface configured to receive a user request to perform karaoke for a specified song, and a controller coupled to the user interface. The controller may be configured to format the user request to provide a performance request that is configured to be queued at a karaoke server. The mobile terminal may also include a transmitter and a receiver coupled to the controller. The transmitter may be configured to transmit the performance request to the karaoke server over a wireless connection, and the receiver may be configured to receive a notification from the karaoke server over a wireless connection at a predetermined time based on an end time of a current karaoke performance. The controller may be further configured to provide audio data to the karaoke server over a wireless connection responsive to receiving the notification.

In some embodiments of the present invention, the mobile terminal may also include a microphone coupled to the controller. The controller may be configured to receive voice data via the microphone, and the transmitter may be configured to transmit the voice data to the karaoke server over the wireless connection.

In other embodiments of the present invention, the mobile terminal may include a display coupled to the controller. The controller may be configured to receive lyric data corresponding to the specified song from the karaoke server over the wireless connection and display the lyric data at the display.

According to yet other embodiments of the present invention, a karaoke server, may include a transceiver, a database, and an audio processor coupled to a controller. The transceiver may be configured to receive first audio data from at least one mobile terminal over a wireless connection thereto. The database may be configured to store second audio data associated with the first audio data. The controller may be configured to retrieve the second audio data from the database and provide the first and second audio data to the audio processor. The audio processor may be configured to mix the first audio data and the second audio data and provide the mixed audio data to a speaker for output.

DETAILED DESCRIPTION OF EMBODIMENTS OF THE INVENTION

Figure 1:
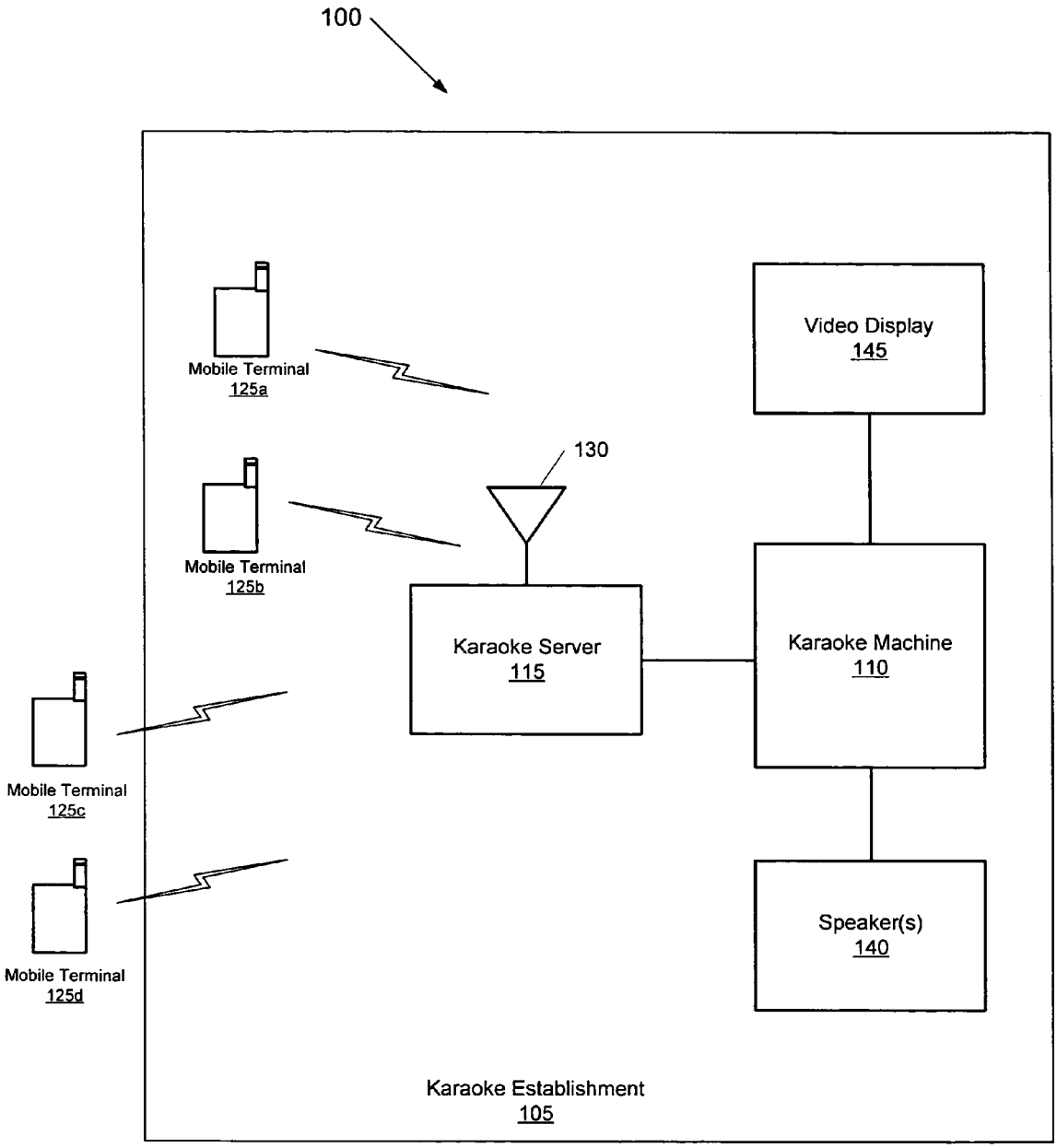
FIG. 1 is a block diagram illustrating karaoke systems and methods according to some embodiments of the present invention.

The present invention will now be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The terminology used herein is for the purpose of describing particular embodiments only and is not intended to be limiting of the invention. As used herein, the singular forms "a," "an," and "the" are intended to include the plural forms as well, unless expressly stated otherwise. It should be further understood that the terms "comprises" and/or "comprising" when used in this specification is taken to specify the presence of stated features, integers, steps, operations, elements, and/or components, but does not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. In contrast, when an element is referred to as being "directly coupled" or "directly connected" to another element, there are no intervening elements present. Furthermore, "connected" or "coupled" as used herein may include wirelessly connected or coupled. As used herein, the term "and/or" includes any and all combinations of one or more of the associated listed items, and may be abbreviated as "/".

It will also be understood that, although the terms first, second, etc. may be used herein to describe various elements, these elements should not be limited by these terms. Rather, these terms may be used to distinguish one element from another. For example, a first mobile terminal could be termed a second mobile terminal, and, similarly, a second mobile terminal could be termed a first mobile terminal without departing from the teachings of the disclosure.

As will be appreciated by one of skill in the art, the present invention may be embodied as methods, systems, and devices. Accordingly, the present invention may be embodied in hardware and/or in software (including firmware, resident software, micro-code, etc.). Computer program code for carrying out operations of the present invention may be written in an object oriented programming language such as Java® programming language, Smalltalk or C++, a conventional procedural programming languages, such as the "C" programming language, or lower-level code, such as assembly language and/or microcode. The program code may execute entirely on a single processor and/or across multiple processors, as a stand-alone software package or as part of another software package. The program code may execute entirely on a mobile terminal and/or karaoke server, or only partly on the mobile terminal and/or karaoke server and partly on another device. In the latter scenario, the other device may be connected to the mobile terminal and/or karaoke server through a wired and/or wireless local area network (LAN) and/or wide area network (WAN), or the connection may be made to an external computer (for example, through the Internet using an Internet Service Provider).

The present invention is described below with reference to flowchart illustrations and/or block and/or flow diagrams of methods, systems, and devices according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block and/or flow diagram block or blocks.

These computer program instructions may also be stored in a computer-readable memory that can direct a computer or other programmable processor to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processor to cause a series of operational steps to be performed on the computer or other programmable processor to produce a computer implemented process such that the instructions which execute on the computer or other programmable processor provide steps for implementing the functions or acts specified in the flowchart and/or block diagram block or blocks. It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

It should be understood, that, as used herein, the term "mobile terminal" may include, but is not limited to, a cellular radiotelephone; a pager; a Personal Communications System (PCS) terminal that may combine a cellular radiotelephone with data processing, facsimile and data communications capabilities; a Personal Data Assistant (PDA) that can include a radiotelephone, pager, Internet/intranet access, Web browser, organizer, calendar and/or a global positioning system (GPS) receiver; and a conventional laptop and/or palmtop portable computer that includes a radiotelephone or other transceiver.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the present application and/or in the context of the relevant art and will not be interpreted in an idealized or overly formal sense unless expressly so defined herein.

FIG. 1 is a block diagram illustrating systems and methods for providing a karaoke service according to some embodiments of the present invention. As shown in FIG. 1, a karaoke system 100 in a karaoke establishment 105 may include a karaoke machine 110, a karaoke server 115 coupled to the karaoke machine 110, and a plurality of mobile terminals 125*a* to 125*d*. The system 100 may further include speakers 140 and a video display 145 coupled to the karaoke machine 110. The karaoke machine 110 may be a device that is configured to combine instrumental and/or synthesized music from a music source with vocal data received from a microphone or other input.

One or more wireless connections may be established between the karaoke server 115 and a number of mobile terminals, such as the mobile terminals 125*a* to 125*d*, to provide a karaoke service. As used herein, a karaoke service may allow performers, such as users of the mobile terminals 125*a* to 125*d*, to sing along with a musical selection such that the voices of the performers are mixed and/or otherwise combined with the musical selection and output for the performers and/or others to hear. For example, a mobile terminal 125*a* may be wirelessly linked to the karaoke server 115 directly through an infrared, Bluetooth® wireless protocol, or Wi-Fi connection. Alternatively, the mobile terminal 125*a* may be wirelessly linked to the karaoke server 115 through a network, which may be a public land mobile network (PLMN) such as a cellular radiotelephone network. More generally, a wireless connection between one or more of the mobile terminals 125*a* to 125*d* and the karaoke server 115 may include any transmission and/or reception of data therebetween over a network, which may be ad hoc or centralized, or other wireless link, such as an infrared (IR) link.

As used herein, a karaoke establishment 105 may include a restaurant, bar, nightclub, and/or any other establishment including a karaoke machine and/or other performance equipment such that karaoke may be performed. In addition, the karaoke establishment 105 may include areas inside the karaoke establishment building, in the karaoke establishment parking lot and/or otherwise on the karaoke establishment premises, and/or areas surrounding and/or immediately adjacent to the karaoke establishment premises.

The karaoke machine 110 may be an analog and/or digital device that is configured to combine, or "mix", instrumental and/or synthesized music with vocal data. As used herein, vocal and/or voice data may include any data that can be produced by a human voice, for example, over a frequency range from about 300 Hz to about 3.4 kHz. The karaoke machine 110 may include a microphone connected thereto, a special CD player, MP3 player, or other music source capable of playing recordings with the vocal tracks removed, a speaker, such as the speaker(s) 140, for broadcasting music, and a screen, such as the video display 145, for displaying lyrics synchronized with the music.

The video display 145 may be a cathode ray tube (CRT), liquid crystal display (LCD), digital light processing (DLP) display, projection display, plasma screen, and/or any other type of display configured to receive and display video content. As such, in the karaoke establishment 105, the video display 145 may be configured to receive lyric data associated with a karaoke performance from the karaoke machine 110 and/or the karaoke server 115, and display the received lyric data. The speakers 140 may include transducers and/or other audio equipment that is configured to receive an electrical signal and convert the electrical energy into mechanical energy/sound.

The mobile terminals 125*a* to 125*d* may be laptop computers, notebook computers, handheld computers, personal communications system (PCS) terminals, personal digital assistants (PDA), pagers, and/or radiotelephones. The mobile terminals 125*a* to 125*d* need not all be identical types of devices. For example, one of the mobile terminals 125*a* to

125*d* may be a radiotelephone, another of the mobile terminals 125*a* to 125*d* may be a handheld computer, and/or still another of the mobile terminals 125*a* to 125*d* may be a PDA. In other embodiments, two or more of the mobile terminals 125*a* to 125*d* coupled to the karaoke system 100 may be of a same type.

The mobile terminals 125*a* to 125*d* may each include a wireless local area network interface transceiver that supports formation of an ad hoc wireless local area network including the karaoke server 115, the mobile terminals 125*a* to 125*d*, and/or additional devices. For example, the mobile terminal 125*a* may use a wireless local area network transceiver to establish a wireless data connection with the karaoke server 115 via a short-range antenna 130. The wireless local area network interface transceiver, for example, may be provided according to a Wi-Fi (IEEE 802.11) standard and/or a Bluetooth® wireless protocol standard operating in the Personal Area Network (PAN) mode. In addition, the wireless connection may be provided using infrared (IR) coupling between the mobile terminals 125*a* to 125*d* and the karaoke server 115.

Alternatively, each of the mobile terminals 125*a* to 125*d* may include the functionality of a PLMN transceiver and/or wireless modem. As such, a mobile terminal 125*a* may use a PLMN transceiver to establish a wireless data connection with the karaoke server 115 through a base station of a network, such as a PLMN, using, for example, a packet switched connection, such as that provided by the Enhanced Data GSM Environment (EDGE) standard, the General Packet Radio Service (GPRS) standard, and/or the Universal Mobile Telecommunications System (UMTS) standard. Also, the mobile terminal 125*a* may establish a wireless connection with the karaoke server 115 through the base station of the network using a circuit switched connection.

Furthermore, each of the mobile terminals 125*a* to 125*d* may include both a wireless local area network transceiver and a PLMN transceiver. Accordingly, a wireless data connection may be established between the karaoke server 115 and the mobile terminals 125*a* to 125*d* using a wireless local area network transceiver, a PLMN transceiver, and/or some combination of the two. For example, mobile terminal 125*a* may use the wireless local area network transceiver to establish a connection with the karaoke server 115, while the PLMN transceiver may be used for other applications supported by the mobile terminal 125*a*. The mobile terminal 125*a* may use the PLMN transceiver to establish a connection with the karaoke server 115, while the wireless local area network or IR transceiver may be used for other applications. In some embodiments, the mobile terminal 125*a* may use both the wireless local area network transceiver and the PLMN transceiver to establish wireless data connections with the karaoke server 115 based on reliability, convenience, and/or other factors. Furthermore, the mobile terminals 125*a* to 125*d* need not all establish respective data connections with the karaoke server 115 by the same means. For example, the mobile terminal 125*a* may establish a data connection with the karaoke server 115 using a wireless local area network transceiver, while the mobile terminal 125*b* may establish a data connection using a PLMN transceiver.

The karaoke server 115 may be a computer and/or other electronic device that is configured to interface between the mobile terminals 125*a* to 125*d* and a karaoke machine, such as the karaoke machine 110, to provide a karaoke service. As such, the karaoke server 115 may include a local area wireless network, IR, and/or PLMN interface for communication with the mobile terminals 125*a* to 125*d*. The karaoke server 115 may also be configured to connect to a conventional karaoke machine, such as the karaoke machine 110, via analog and/or digital means, depending on the functionality of the karaoke machine. The connection may permit the karaoke server 115 to queue up songs accessible to the karaoke machine 110 based on received performance requests, to initiate playing of songs for a karaoke performance, and/or to receive requests from users of the mobile terminals 125*a* to 125*d*.

For example, the mobile terminal 125*a* may be configured to receive a user request to perform karaoke at a user interface thereof, format the user request to provide a performance request that is configured to be queued at the karaoke server 115, and transmit the performance request to the karaoke server 115 over a wireless connection. The karaoke server 115 may be configured to receive the performance request from the mobile terminal 125*a* (in addition to performance requests associated with other mobile terminals) over the wireless connection. Each performance request may include song data, performer data, and/or associated mobile terminal data. Each performance request may also be associated with more than one mobile terminal, for example, for a duet.

The karaoke server 115 may queue the received performance requests in a selected order to provide a karaoke performance schedule, including, for example, a list of scheduled songs, performers (i.e., based on associated mobile terminals), and/or estimated performance times. The karaoke server 115 may identify a next performance request based on the karaoke performance schedule, determine an end time of a current karaoke performance, and transmit a notification to one or more corresponding mobile terminals, such as the mobile terminal 125*a*, at a predetermined time based on the determined end time. For example, the predetermined time may be selected based on a communication/response time to reduce delay between performances and/or improve utilization of the karaoke machine 110. The mobile terminal 125*a* may receive the notification from the karaoke server 115 over a wireless connection at the predetermined time, and may transmit audio data to the karaoke server 115 over a wireless connection responsive to receiving the notification.

An appropriately enabled mobile terminal, such as the mobile terminal 125*a*, may thus transmit audio data associated with a karaoke performance to the karaoke server 115 over a wireless connection. The audio data may be voice data and/or other audio that may be input through the mobile terminal 125*a*. The karaoke server 110 may transmit the received voice data to the karaoke machine 110, which may mix the voice data with corresponding instrumental music data and broadcast the mixed audio via the speaker(s) 140. Accordingly, users of the mobile terminals 125*a* to 125*d* may be able perform karaoke songs using a wireless link with the karaoke server 115.

Although FIG. 1 illustrates an exemplary karaoke system 100, it will be understood that the present invention is not limited to such configurations, but is intended to encompass any configuration capable of carrying out the operations described herein. For example, although illustrated as separate components in FIG. 1, the karaoke machine 110 and the karaoke server 115 may be included in a single device. For example, the functionality of the karaoke machine 110 may be included in the karaoke server 115. More particularly, the karaoke server 115 may contain a song/music library (including music and lyrics) stored, for example, in a digital format such as MP3, and may be directly connected to the video display 145 and the speaker(s) 140. As such, the karaoke server 115 may be configured to transmit video content to the video display 145 and audio content to the speaker(s) 140 to provide the karaoke service, and the karaoke machine 110 may not be required.

Figure 2:
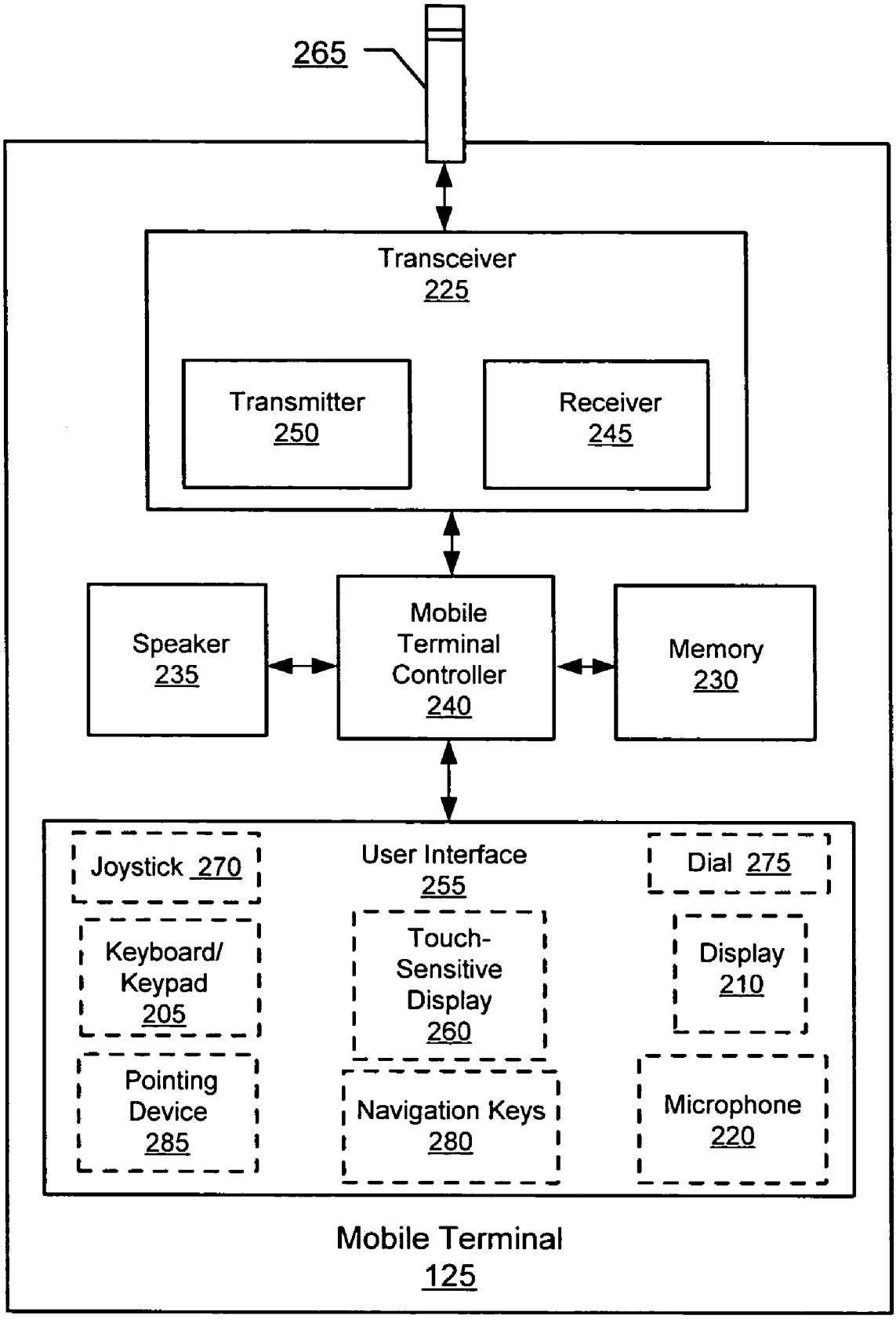
FIG. 2 is a block diagram illustrating a mobile terminal according to some embodiments of the present invention.

FIG. 2 is a block diagram illustrating a mobile terminal 125 according to some embodiments of the present invention. The mobile terminal 125 may correspond to one of the mobile terminals 125*a* to 125*d* of the karaoke system 100 of FIG. 1. As shown in FIG. 2, the mobile terminal 125 includes a transceiver 225, an antenna 265, a mobile terminal controller 240, a memory 230, a speaker 235, and a user interface 255. Depending on functionalities offered by the mobile terminal 125, the user interface 255 may include a microphone 220, a display 210 (such as a liquid crystal display), a joy stick 270, a keypad 205, a touch sensitive display 260, a dial 275, directional/navigation key(s) 280, and/or a pointing device 285 (such as a mouse, track ball, touch pad, etc.). However, additional and/or fewer elements of the user interface 255 may actually be provided. For example, the touch sensitive display 260 may be provided in a PDA without a display 210, without a keypad 205, and/or without a pointing device 285.

The transceiver 225 includes a transmitter 250 and a receiver 245. The transceiver 225 may be configured to transmit requests and/or audio data to a karaoke server, such as the karaoke server 115 of FIG. 1, via the transmitter 250, and may be configured to receive notifications and/or other data from the karaoke server via the receiver 245, over a wireless connection. The transceiver 225 may include a wireless local area network interface transceiver and/or a PLMN transceiver. Accordingly, the transceiver 225 may be configured to establish a wireless connection with the karaoke server by calling a connection number using the PLMN transceiver. In addition, the transceiver 225 may be configured to establish a wireless connection with the karaoke server according to a wireless local area networking standard, such as Wi-Fi and/or Bluetooth® wireless protocol, using the wireless local area network interface transceiver. Network security for the wireless local area network (such as encryption and/or authentication) may be provided according to the applicable network standard being used. While a single antenna 265 is illustrated in FIG. 2 by way of example, separate antennas may be provided for the PLMN transceiver and/or the wireless network interface transceiver. Also, multiple antennas may be shared by the PLMN transceiver and wireless network interface transceiver, and/or multiple antennas may be provided for one or both of the PLMN transceiver and wireless network interface transceiver. In addition, the transceiver 225 may include an IR interface configured to establish a wireless connection with the karaoke server via IR coupling.

Still referring to FIG. 2, the mobile terminal controller 240 is coupled to the transceiver 225, the memory 230, the speaker 235, and the user interface 255. The controller 240 may be, for example, a commercially available or custom microprocessor that is configured to coordinate and manage operations of the transceiver 225, the memory 230, the speaker 235, and the user interface 255. As such, the mobile terminal controller 240 may be configured to provide a karaoke service by establishing a wireless connection, such as an infrared, Bluetooth® wireless protocol, Wi-Fi, and/or PLMN connection, with a karaoke server, such as the karaoke server 115 of FIG. 1, using the transceiver 225 and/or other communication interface.

More particularly, the controller 240 may be configured to receive a user request to perform karaoke for a specified song via the user interface 255, and format the user request to provide a performance request. The performance request may be provided in a format that may be suitable to be queued at the karaoke server. The controller 240 may be configured to transmit the performance request to the karaoke server over a wireless connection via the transmitter 250 or other interface. In addition, the performance request may be provided to the karaoke server by alternate means, for example, by directly entering the request at a user interface of the karaoke server. The controller 240 may further be configured to receive a notification from the karaoke server over a wireless connection at a predetermined time based on an end time of a current karaoke performance via the receiver 245, and provide audio data to the karaoke server over a wireless connection via the transmitter 250 (or other interface) responsive to receiving the notification. The audio data may be transmitted using a known transmission technology, such as audio streaming. More particularly, the controller 240 may be configured to receive voice data, for example, from a karaoke performer, via the microphone 220. The voice data may correspond to the song specified in the user request. The transmitter 250 may be configured to transmit the voice data to the karaoke server over the wireless connection to provide a karaoke service using via the mobile terminal 125.

Additional information may also be communicated between the mobile terminal 125 and the karaoke server in both directions over the wireless connection(s). For example, the controller 240 may be configured to receive lyric data corresponding to the specified song from the karaoke server over the wireless connection via the receiver 245, and display the lyric data on the display 210. As such, a user may view the lyric data on the display 210 of the mobile terminal 125 and concurrently sing into the microphone 220, for example, when the mobile terminal 125 is not in the karaoke establishment 105 and/or is otherwise out of view of the video display 145. Such a feature may be of greater use, for instance, where a hands-free accessory, such as a wired or wireless earpiece including a microphone therein, is used with the mobile terminal 125, so that the user can sing into the microphone 220 and view the lyric data on the display 210 of the mobile terminal 125 at the same time.

In addition, the controller 240 may be configured to receive a user request to view the performance schedule from the user interface 255, and may be configured to transmit a performance schedule query to the karaoke server via the transmitter 250 responsive to receiving the user request. The performance schedule query may inquire, for example, about scheduled times for a particular performer (for example, based on an associated mobile terminal) and/or song listed in the performance schedule. The controller 240 may be further configured to receive at least a portion of the karaoke performance schedule from the karaoke server via the receiver 245. The portion of the performance schedule may correspond to the performer and/or song specified in the performance schedule query. The received portion of the karaoke performance schedule may be displayed on the display 210.

Likewise, the controller 240 may be configured to receive a user request to view a list of song library information from the user interface 255. The song library information may include a listing of songs stored at the karaoke server and/or the karaoke machine that are available to perform. The controller may be configured to transmit a song database query to the karaoke server via the transmitter 250 responsive to receiving the user request. The song database query may inquire about the available songs, for example, based on title, artist, lyrics, genre, and/or other specified parameters. The controller 240 may be further configured to receive the list of song library information from the karaoke server via the receiver 245. The list of song library information may correspond to the specified parameters in the song database query. The received list of song library information may be displayed on the display 210, and the user interface 255 may be configured to receive a selection from the displayed list of song library information to be included in the performance request.

In some embodiments, the controller 240 may be configured to execute an application stored in the memory 230 that presents a menu of options enabling users to view the list of performers in the performance schedule, view the song library, choose a song, and queue a song to perform. Accordingly, a user of the mobile terminal 125 may make music selections from a song library, view a list of those scheduled to perform, and/or request to be added to the karaoke performance schedule over a wireless connection with the karaoke server.

Although FIG. 2 illustrates an exemplary mobile terminal that may be used to provide a karaoke service in conjunction with a karaoke server, it will be understood that the present invention is not limited to such a configuration but is intended to encompass any configuration capable of carrying out the operations described herein. For example, although the memory 230 is illustrated as separate from the controller 240, the memory 230 or portions thereof may be included as a part of the controller 240. Also, although the controller 240 is described above as being configured to run an application to provide the karaoke service, the application may be stored and/or executed on the karaoke server, and may be accessed, for example, using a web browser associated with the mobile terminal 125. More generally, while particular functionalities are shown in particular blocks by way of illustration, functionalities of different blocks and/or portions thereof may be combined, divided, and/or eliminated.

Figure 3:
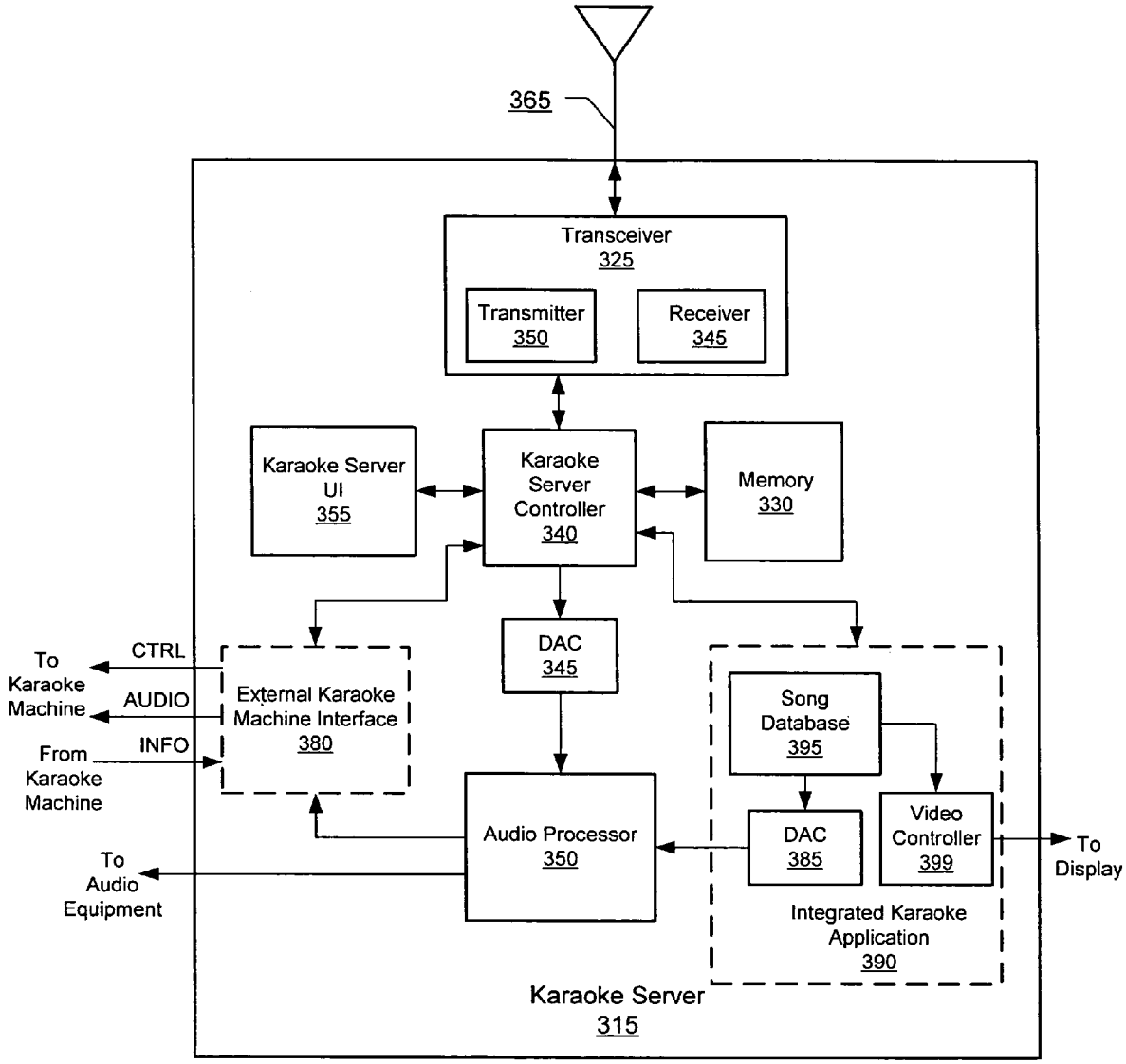
FIG. 3 is a block diagram illustrating a karaoke server according to some embodiments of the present invention.

FIG. 3 is a block diagram illustrating a karaoke server 315 according to some embodiments of the present invention. In some embodiments, the karaoke server 315 may correspond to the karaoke server 115 of the karaoke system 100 of FIG. 1. Referring now to FIG. 3, the karaoke server 315 includes a karaoke server controller 340 coupled to a transceiver 325 (including a transmitter 350 and a receiver 345), a memory 330, an audio processor 350 (via a digital-to-analog converter 345), and a karaoke server user interface (UI) 355. The controller 340 may be, for example, a commercially available or custom microprocessor that is configured to coordinate and manage operations of the transceiver 325, the memory 330, the karaoke server user interface 355, and the audio processor 350. The audio processor 350 may be a digital and/or analog signal processor, depending on the functionalities provided by the karaoke server 315. The transceiver 325 may include a wireless local area network interface transceiver, a PLMN transceiver and/or an IR transceiver, similar to the transceiver 225 of the mobile terminal 125 of FIG. 2 as described above. The karaoke server 315 may also include an antenna 365, similar to the antenna 265 of the mobile terminal 125 of FIG. 2 as described above.

Accordingly, the controller 3411 may be configured to establish one or more wireless connections, such as infrared, Bluetooth® wireless protocol, Wi-Fi, and/or PLMN connections, with one or more mobile terminals, such as the mobile terminals 125*a* to 125*d* of FIG. 1, using the transceiver 325. The wireless connections may be established responsive to receiving connection requests from the mobile terminals. The controller 340 may thereby receive performance requests associated with a plurality of mobile terminals. For example, the performance requests may be received directly from the mobile terminals via the transceiver 325 over respective wireless connections thereto. In addition, performance requests may be received at the controller 340 via the karaoke server user interface 355. For example, the performance requests may be directly entered at the user interface 355, which may include mobile terminal information sufficient to associate the performance request with one or more of the mobile terminals.

The controller 340 may be configured to queue the received performance requests in a selected order to provide a karaoke performance schedule. For example, the controller 340 may queue the performance requests based on an order of receipt to provide the karaoke performance schedule. In addition, the controller 340 may queue the performance requests based on priority data associated with one or more requests, such as a preferred user identifier, mobile terminal identifier, or other identifier entered, for example, through the karaoke server user interface 355. The controller 340 may be further configured to determine an end time of a current karaoke performance, and identify a next performance request based on the karaoke performance schedule. As such, the controller 340 may provide a notification to one or more mobile terminals associated with the next performance request at a predetermined time based on the determined end time. For example, the notification may be a message alerting a user of a mobile terminal associated with the next performance request that he/she is scheduled to perform karaoke in approximately five minutes. The notification may also alert the user at multiple predetermined intervals prior to his/her scheduled performance, to provide a countdown function. The notification may be transmitted to the one or more mobile terminals over a wireless connection via the transceiver 325.

After transmitting the notification, the controller 340 may be configured to receive audio data from the mobile terminal associated with the next performance request over a wireless connection. For example, the audio data may be vocal/voice data for a karaoke performance received via a microphone of the mobile terminal and transmitted to the karaoke server 315 via the transceiver 325. More particularly, when a singer performs, the controller 340 may set up an audio stream with the mobile terminal, and may route the received audio data through the DAC 345, which translates the digital stream into analog audio data. The analog audio data may be routed to the audio processor 350 of the karaoke server 315, which may add effects (if requested), perform audio mixing, and/or provide amplified audio data to audio equipment for output.

Also, the controller 340 may establish wireless connections with multiple mobile terminals simultaneously. As such, the received voice data may be voice data transmitted from a plurality of mobile terminals to provide multi-user karaoke, for example, for a duet. The audio processor 350 may be configured to mix the voice data from the plurality of mobile terminals prior to providing the received voice data to the karaoke machine. However, due to bandwidth limitations, the number of singers at a given time may be limited. Also, the wireless connection used to transmit the notification may be a different wireless connection than the one used to receive the performance request and/or the wireless connection used to receive the audio data, to provide, for example, flexible and/or efficient use of available bandwidth.

In addition, the controller 340 may provide performance schedule and/or song library information over wireless connections with the mobile terminals, and/or may receive performance option preferences from the mobile terminals. For example, responsive to receiving and queuing each performance request, the controller 340 may transmit karaoke performance schedule information to the requesting mobile terminals, to provide them with estimated times for their respective performances. Also, the controller 340 may be configured to receive a performance schedule query from a mobile terminal and provide karaoke performance schedule data to the querying mobile terminal. The performance schedule query may allow searching of the performance schedule, for example, by performer, song, and/or scheduled time. Moreover, the controller 340 may be configured to receive a song database query from a mobile terminal over a wireless connection, and may transmit a list of song library information to the querying mobile terminal. The song database query may allow searching of the song database, for example, by title, artist, lyrics, and/or genre. As such, a user of a mobile terminal may search through the available songs and/or scheduled performances over a wireless connection to the karaoke server 315.

Still referring to FIG. 3, the audio data output from the audio processor 350 may be provided to an audio input of a karaoke machine, such as the karaoke machine 110 of FIG. 1. As such, the karaoke server 315 may include an external karaoke machine interface 380. For example, the external karaoke machine interface 380 may provide unbalanced microphone, balanced XLR, and/or line level audio to match common audio inputs available on the karaoke machine. The karaoke machine may then mix the received audio data with instrumental music data for the song specified in the performance request, and output the resulting audio to speaker(s), such as the speaker(s) 140, for output. Accordingly, where the functionality of the karaoke machine is implemented as a separate element from the karaoke server 315, the karaoke server 315 output may be received as a microphone audio input channel from the perspective of the karaoke machine.

The external karaoke machine interface 380 may also be configured to receive manually entered performance requests that may or may not be associated with a mobile terminal. As such, the controller 340 may be configured to queue the manually entered performance requests together with the performance requests from the mobile terminals in a selected order to provide the karaoke performance schedule.

In addition, the karaoke machine may include automatic and/or digital controls (for example, to cue CDs, send song library information, adjust audio, etc.). As such, the karaoke server 315 may perform such functions, for example, to replace a human DJ. Accordingly, the external karaoke machine interface 380 may be configured to provide a bidirectional control connection between the karaoke server 315 and the karaoke machine. More particularly, the external karaoke machine interface 380 may receive information signals (INFO) from the karaoke machine, and may provide control signals (CTRL), for example, to select the next CD to play and/or to request the list of available songs, and/or voice data and/or other audio data for a karaoke performance (AUDIO) to the karaoke machine.

Alternatively, the karaoke machine may have manual controls, such that a human DJ may be required for operation. As such, the DJ may use the karaoke server user interface 355 of the karaoke server 315 to manage the performance schedule and manually cue music on the karaoke machine 110. For example, the karaoke server user interface 355 may display the time and/or performer associated with the next performance request, and the human DJ may cue the next CD as required. The karaoke server 315, however, may still manage the performance schedule and route audio data received from the mobile terminals to the karaoke machine, as described above.

In some embodiments of the present invention, the karaoke server 315 may include an integrated karaoke application 390 coupled to the karaoke server controller 340. The integrated karaoke application 390 may include a song database 395, a digital-to-analog converter 385, and a video controller 399. The song database 395 may include the entire song library that is available for karaoke performances, for example, stored in a digital music format, such as MP3. The song database 395 may be locally stored at the karaoke server 315, or may be remotely stored at another server and accessed by the karaoke server 315, for example, via the transceiver 325 and/or other interface. As such, the controller 340 may select digital songs from the song database 395, and may route the selected songs to the audio processor 350 for mixing with the received vocal/voice data.

More particularly, the transceiver 325 may be configured to receive audio data from at least one mobile terminal over a wireless connection thereto, as described above. The audio data may be voice data received via a microphone of the mobile terminal associated with the song specified for the next performance request. The controller 340 may be configured to retrieve instrumental music data corresponding to the song specified in the performance request from the song database 395, and may provide the vocal/voice data and the instrumental music data to the audio processor 350. The audio processor 350 may be a digital signal processor that is configured to mix the vocal/voice data and the instrumental music data. The audio processor 350 may be further configured to perform additional signal processing as specified and/or desired. The mixed audio data may then be provided to a speaker, such as the speaker(s) 145 of FIG. 1, or other audio equipment for output.

The controller 340 may be further configured to retrieve lyric data corresponding to the song specified in the performance request from the song database. The lyric data may be provided via the video controller 399 to a video display, such as the video display 145 of FIG. 1, so that the audience and/or performer(s) may see the lyrics. The lyric data may also be transmitted to a display of the mobile terminal(s) associated with the performance, for example, via the transceiver 325.

Thus, where the karaoke server 315 includes an integrated karaoke application 390, the voice and instrumental music data may be mixed at the audio processor 350, the mixed audio data may be routed directly to the sound system/speakers, and the lyric data may be routed directly to the video display. As such, the external karaoke machine interface 380 and the associated control/information/audio paths may not be used by or included in the karaoke server 315.

Although FIG. 3 illustrates an exemplary karaoke server that may be used in conjunction with one or more mobile terminals to provide a karaoke service, it will be understood that the present invention is not limited to such a configuration but is intended to encompass any configuration capable of carrying out the operations described herein.

Figure 4A:
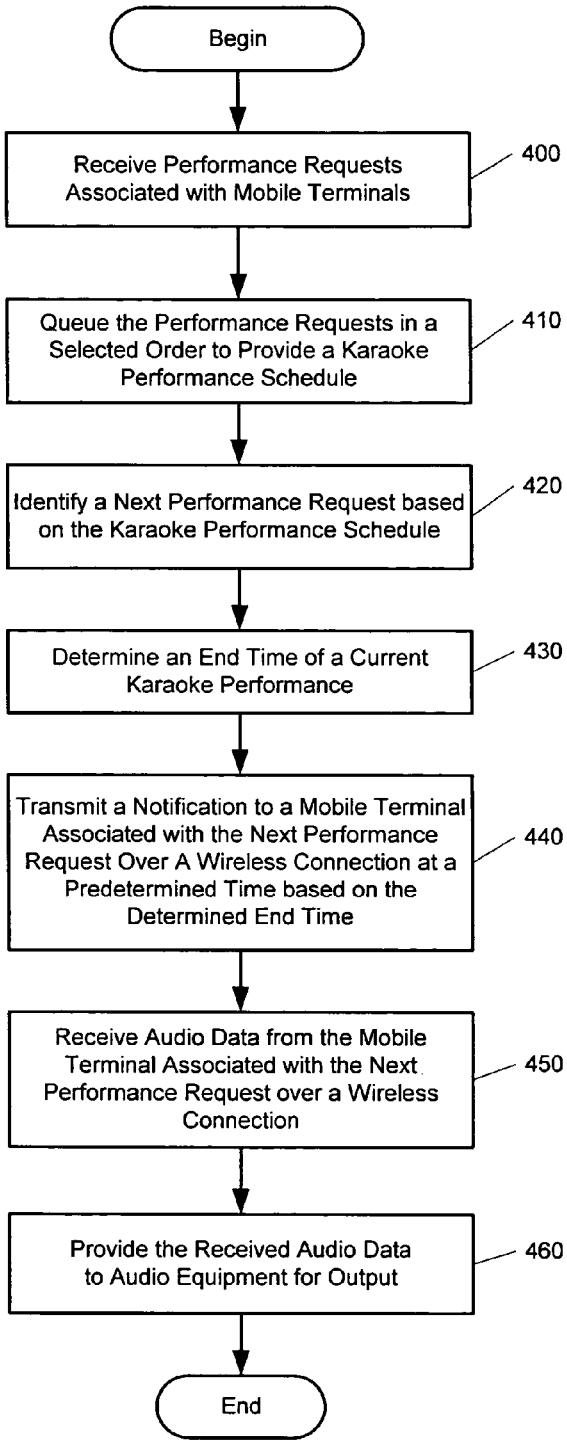
FIGS. 4A and 4B are flowcharts illustrating operations performed by a karaoke server according to some embodiments of the present invention.
Figure 4B:
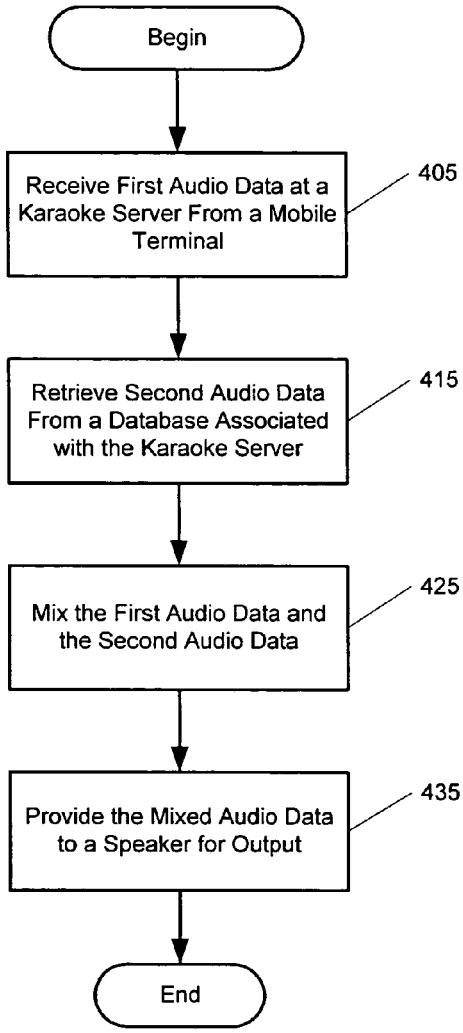

Operations for providing a karaoke service in accordance with some embodiments of the present invention will now be described with reference to the flowcharts of FIGS. 4A, 4B, and 5. FIGS. 4A and 4B illustrate operations which may be performed by a karaoke server, such as the karaoke server 315 of FIG. 3, according to some embodiments of the present invention. Referring now to FIG. 4A, operations begin at block 400 when one or more performance requests associated with one or more mobile terminals are received. The performance requests may be received directly from the mobile terminals, for example, over respective wireless connections. The wireless connections may be infrared, Bluetooth® wireless protocol, Wi-Fi, and/or PLMN connections. The performance requests may include song data, performer data, and/or associated mobile terminal data. In addition, the performance requests may include performance option preferences, such as pitch change, hall effects (i.e. echo), bass boost, treble boost, or audio compression.

The received performance requests are queued in a selected order to provide a karaoke performance schedule (block 410).

For example, the performance requests may be queued based on an order of receipt to provide the karaoke performance schedule. In addition, the performance requests may be queued based on associated priority data to provide the karaoke performance schedule. For instance, a karaoke server, a mobile terminal, and or the performance request itself may be configured to store priority data indicating that a particular user is a "preferred" user, such as a user who has contributed additional fees for the karaoke service. As such, upon receiving a performance request associated with the user and/or the user's mobile terminal, the performance request may be given priority in the queue over earlier and/or concurrently received performance requests.

The karaoke performance schedule may include an ordered listing of songs to be performed and the corresponding performers. For example, the karaoke performance schedule may include a plurality of designated timeslots, and each song/performer corresponding to a performance request may be assigned to one of the designated timeslots. Responsive to receiving each performance request, at least a portion of the karaoke performance schedule may be transmitted to corresponding mobile terminals, so that users of the mobile terminals may view the scheduled time and/or order for their respective performances. Also, a mobile terminal user in the karaoke establishment who is not currently scheduled to perform may wish to view the karaoke performance schedule, for example, to see how many people and/or which songs are scheduled for performance. Accordingly, the karaoke performance schedule may be transmitted to a querying mobile terminal responsive to receiving a performance schedule query from the mobile terminal. Similarly, song library information, such as a listing of songs that may be available to perform, may be transmitted to a querying mobile terminal responsive to receiving a song database query from the mobile terminal. The song library information may be organized by title, artist, genre, and/or other parameters specified by the song database query.

In addition, manually-entered performance requests that are not associated with mobile terminals may also be received and queued at block 410 together with the performance requests associated with the mobile terminals. As such, the karaoke performance schedule may include performance requests associated with conventional karaoke performances (i.e., via a microphone coupled to the karaoke machine), as well as performance requests associated with karaoke performances according to some embodiments of the present invention.

Still referring to FIG. 4A, a next performance request is identified based on the karaoke performance schedule (block 420), and an end time of a current karaoke performance is determined (block 430). A notification is transmitted to the mobile terminal associated with the next performance request at a predetermined time based on the determined end time (block 440). For example, the notification may be transmitted a few minutes prior to the end of the current karaoke performance and/or before a designated timeslot associated with the next performance request, to alert the user of the mobile terminal associated with the next performance request of his upcoming performance. The notification may be transmitted over a wireless connection, which may be a different wireless connection than the one over which the corresponding performance request was received.

Responsive to the notification, audio data may be received from the mobile terminal associated with the next performance request over a wireless connection (block 450). For example, the audio data may be vocal/voice data received via a microphone of the mobile terminal associated with the next performance request, and may be received over the wireless connection during a designated timeslot of the performance schedule assigned to the next performance request. In addition, the vocal/voice data may be received from more than one mobile terminal, for example, for a duet. As such, the vocal/voice data from multiple mobile terminals may be mixed at the karaoke server. The audio data may be received via a known transmission technology, such as audio streaming. The received audio data may then be provided to audio equipment for output (block 460).

For example, where the karaoke server is connected to a separate karaoke machine, the received vocal/voice data may be provided to the karaoke machine to be mixed with instrumental music data and output via speakers coupled to the karaoke machine. Where the karaoke server includes an integrated karaoke application including a song database, the instrumental music data corresponding to the song specified in the performance request may be retrieved from the song database, and the received vocal/voice data may be mixed with the retrieved instrumental music data and output to speaker(s) coupled to the karaoke server.

In some instances, a user of the mobile terminal associated with the next performance request may miss his scheduled performance time. As such, if audio data is not received from the mobile terminal responsive to transmitting the notification, the next performance request may be rescheduled in the performance schedule. For example, the performance request may be rescheduled at the end of the performance schedule, or at another timeslot based on a priority associated with the request. In some embodiments, the performance request may be deleted from the performance schedule and/or may be manually rescheduled.

Additional operations for providing a karaoke service that may be performed by a karaoke server, such as the karaoke server 315 of FIG. 3, will now be described with reference to FIG. 4B. As shown in FIG. 4B, operations begin at block 405 when first audio data from a mobile terminal is received at a karaoke server. The first audio data may be voice data received, for example, via a microphone associated with the mobile terminal. Also, second audio data is retrieved from a database associated with the karaoke server (block 415). For example, the database may be a song database, and the second audio data may be instrumental music data that is associated with the first audio data. The second audio data may be stored in the database in a digital music format, such as the MP3 format. More particularly, the first audio data may be voice data corresponding to a song selected for a karaoke performance, and the second audio data may be the instrumental music data (i.e., music without the vocal component) corresponding to the selected song. In addition, lyric data corresponding to the instrumental music data may be retrieved from the song database. The lyric data may be transmitted to a display of the mobile terminal and/or to an external display, such as the video display 145 of FIG. 1.

Still referring to FIG. 4B, the first audio data from the mobile terminal and the second audio data retrieved from the database are mixed (block 425). For example, the first and second audio data may be mixed at the karaoke server. Additional processing, mixing, and/or amplification may also be performed at the karaoke server. As such, the karaoke server may include much of the functionality of a karaoke machine, such as the karaoke machine 110 of FIG. 1. In other embodiments, the first and second audio data may be mixed and/or otherwise processed at a karaoke machine. The mixed audio data is then provided to a speaker for output (block 435). Accordingly, a karaoke server according to some embodiments of the present invention may provide a karaoke service using vocal/voice data received from a mobile terminal.

Figure 5:
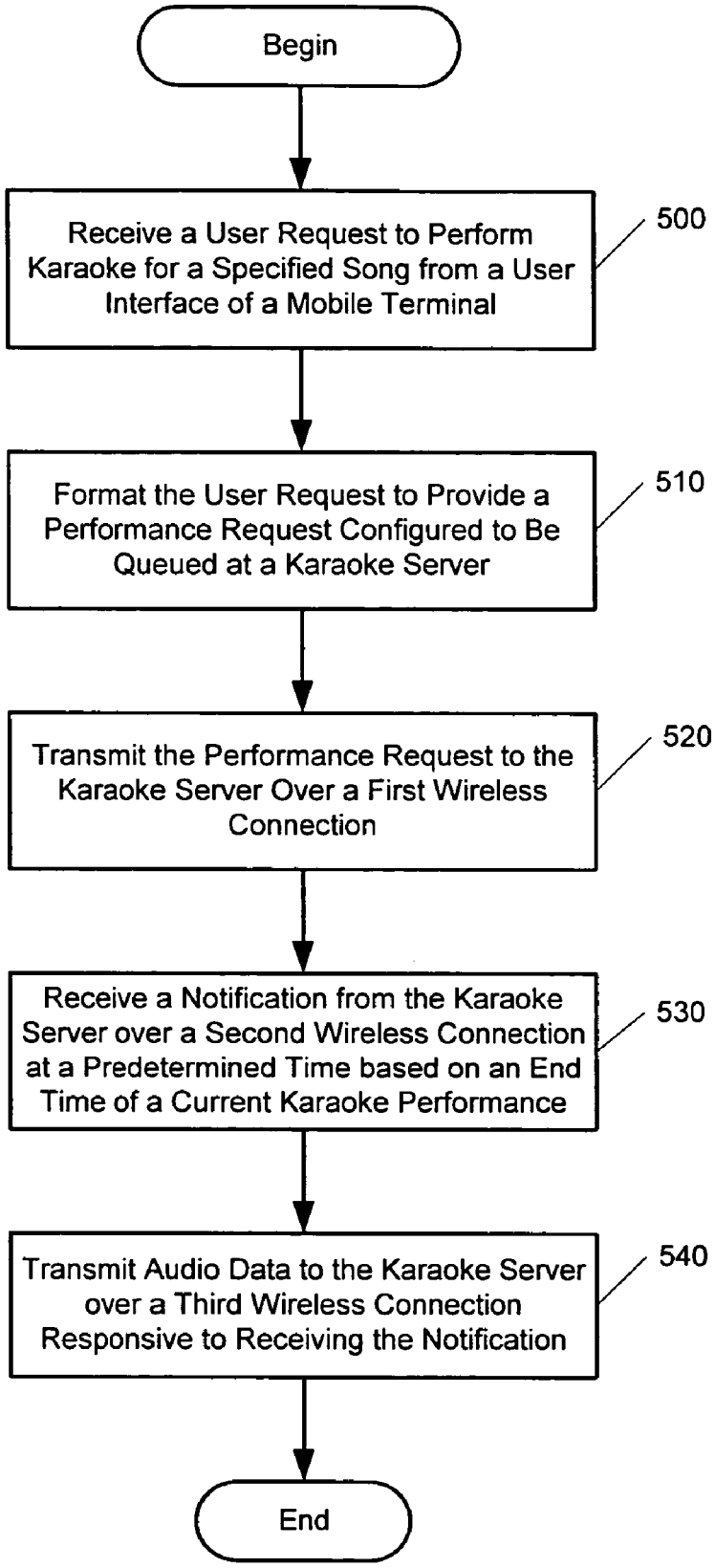
FIG. 5 is a flowchart illustrating operations performed by a mobile terminal according to some embodiments of the present invention.

FIG. 5 illustrates operations for providing a karaoke service which may be performed by a mobile terminal, such as the mobile terminal 125 of FIG. 2, according to some embodiments of the present invention. Referring now to FIG. 5, operations begin at block 500 when a user request to perform karaoke for a specified song is received from a user interface of a mobile terminal. The user request is formatted to provide a performance request that is configured to be queued at a karaoke server (block 510). The performance request may include, for example, the specified song, identification information for the user/performer, priority data associated with the user, and/or mobile terminal identification information.

After formatting the user request to provide the performance request, a first wireless connection is established with the karaoke server. The first wireless connection may be, for example, an infrared, Bluetooth® wireless protocol, Wi-Fi, and/or a PLMN connection. The performance request is transmitted to the karaoke server over the first wireless data connection (block 520). For example, the mobile terminal may receive a designated performance slot in a karaoke performance schedule at the karaoke server based on an order of receipt and/or a priority of the performance request.

Still referring to FIG. 5, a notification is received from the karaoke server over a second wireless connection (block 530). The second wireless connection may be a different wireless connection, or may be the same connection as the first wireless connection. The notification is received from the karaoke server at a predetermined time, based on an end time of a current karaoke performance. As such, the notification may alert a user of the mobile terminal of an upcoming karaoke performance.

Audio data is transmitted to the karaoke over a third wireless connection responsive to receiving the notification (block 540). The audio data may be transmitted using a known transmission technology, such as audio streaming. The audio data may be vocal/voice data corresponding to the song specified in the performance request. The vocal/voice data may be received via a microphone of the mobile terminal, such as the microphone 220 of FIG. 2. In addition, lyric data corresponding to the song specified in the performance request may be received and displayed on the mobile terminal, for example, on the display 210 of FIG. 2. As such, a user/performer may view the received lyric data on the display of the mobile terminal, and may concurrently provide corresponding vocal data via the microphone for transmission to the karaoke server over the third wireless connection. The third wireless connection may be a same or a different wireless connection than the first and/or second wireless connections. As such, the first, second, and/or third wireless connections may be a same or different infrared, Bluetooth® wireless protocol, Wi-Fi, and/or PLMN connections, depending, for example, on bandwidth limitations of the karaoke server.

Additional information may also be provided by the karaoke server over a wireless connection. For example, a user request to view the performance schedule may be received at the user interface of the mobile terminal, and a performance schedule query may be transmitted to the karaoke server based on the user request. The user request may specify, for example, a performer, song, and/or scheduled time for which the user desires additional information. As such, the performance schedule query may be formatted to allow searching of the performance schedule based on the specified information. Portions of the karaoke performance schedule corresponding to the query may be received from the karaoke server and displayed on a display of the mobile terminal.

Similarly, a user request to view song library information may be received at the user interface of the mobile terminal, and a song database query may be transmitted to the karaoke server based on the user request. The user request may specify, for example, a particular song title, artist, and/or genre for which the user wishes to perform karaoke, and the song database query may be formatted to allow searching of the song library information for the specified parameters. As such, a list of song library information corresponding to the query may be received from the karaoke server and displayed on a display of the mobile terminal.

Figure 6:
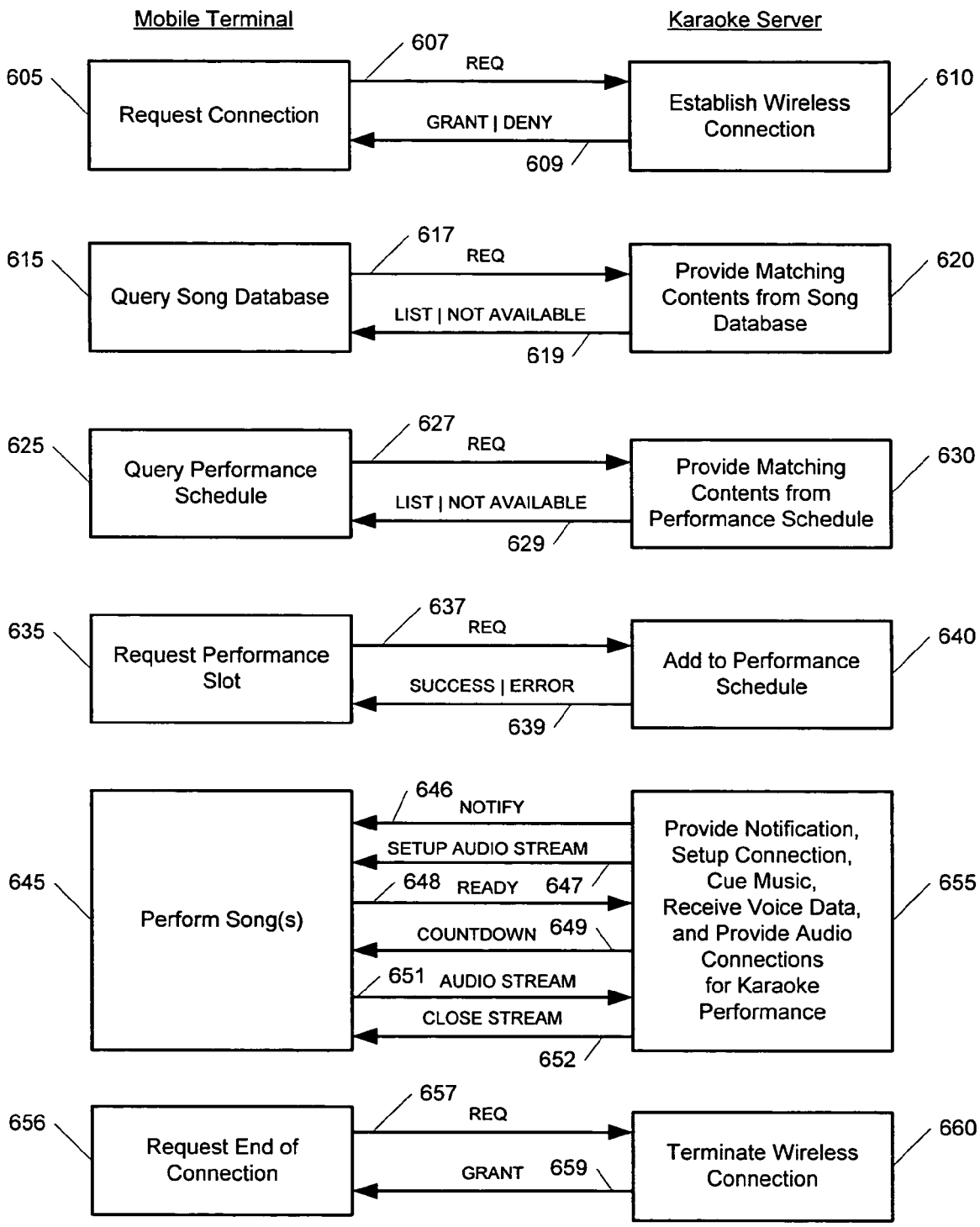
FIG. 6 is a flow diagram illustrating operations for providing a karaoke service according to some embodiments of the present invention.

FIG. 6 is a flow diagram illustrating operations for providing a karaoke service according to some embodiments of the present invention. More particularly, FIG. 6 illustrates a protocol for communications that may be exchanged between a karaoke server and a mobile terminal to provide a karaoke service according to some embodiments of the present invention.

Referring now to FIG. 6, a mobile terminal requests a wireless connection (block 605) with a karaoke server. As such, a request (REQ) 607 is wirelessly transmitted from the mobile terminal to the karaoke server. The karaoke server grants (or denies) the request by transmitting a response (GRANT/DENY) 609, thereby establishing the wireless data connection (block 610). The wireless data connection may be, for example, an infrared, Bluetooth® wireless protocol, or Wi-Fi connection. The karaoke server may allow one or more mobile terminals to join the server for a karaoke session. However, there may be a limit on the maximum number of server-mobile terminal pairings that the karaoke server can handle. If this limit is exceeded, the response 609 from the karaoke server may deny the connection, or may provide a message asking the mobile terminal to retry. As there may be no need for a mobile terminal to remain paired unless actually performing, the karaoke server can maintain a list of pairing IDs. As such, the mobile terminal may not need to repeat the entire pairing process for each communication.

Using the wireless connection, the mobile terminal may query a song database associated with and/or accessible by the karaoke server for available song library information (block 615). As such, a request (REQ) 617 including the desired search parameters is wirelessly transmitted from the mobile terminal to the karaoke server. For example, audience members can use their mobile terminals to search and view the list of available karaoke songs by title, artist, lyrics and/or genre. The karaoke server transmits a response (LIST/NOT AVAILABLE) 619 including a list of results, if available, to provide matching contents from the song database (block 620). Songs from the list can be added/deleted from a "favorites" list for a mobile terminal. Since the song list can be quite large, it may be stored on the karaoke server and downloaded page-by-page to a mobile terminal on demand. In some instances, an audience member may not want to sing, but may wish to request a song for another to perform. As such, a list of songs in the library can be added to a "request list" that all audience members can see and choose from via their mobile terminals. However, if no information from the song database matches the provided search parameters, a "not available" response 619 is transmitted to the mobile terminal from the karaoke server.

Similarly, the mobile terminal may query a karaoke performance schedule maintained by the karaoke server using the wireless connection (block 625). Accordingly, a request (REQ) 627 including the desired search parameters is wirelessly transmitted from the mobile terminal to the karaoke server. The karaoke performance schedule may include the performers and/or songs that are currently scheduled to perform. The karaoke server transmits a response (LIST/NOT AVAILABLE) 629 including a list of results, if available, to provide matching contents from the performance schedule (block 630). As such, audience members may find a specific performer's name or song in the list. Also, since the karaoke server knows the playing time of each song, the karaoke performance schedule may list the approximate times for each scheduled performance. The karaoke server may also provide each listed performer with a notification and/or countdown at a predetermined time before the scheduled performance.

The wireless connection may also be used by the mobile terminal to request a performance slot (block 635). More particularly, a request for a performance slot (REQ) 637 is wirelessly transmitted from the mobile terminal to the karaoke server. The performance request 637 may include a specified song, for example, based on the song library information provided in the song database. The performance request 637 may further include the performer's name (which can be anonymous), a specific time/timeslot for performance, names of other performers who wish to perform as a group, and/or a request to perform a group of songs sequentially. The performance request 637 may also include desired options such as pitch change, hall effects, bass boost, treble boost, audio compression, type and advance time for warning/notification, and/or whether lyrics are to be sent to the device. In addition, the performance request 637 may include options regarding a missed performance cue, such as deleting the performance request from the performance schedule, moving the performance request to the end of the list, and/or rescheduling manually. The karaoke server may transmit a response (SUCCESS/ERROR) 639 to the mobile terminal indicating success (if the specified song and/or other preferences are available), or otherwise, unavailability. For example, the karaoke server may queue the performance request 637 on a first-come-first-serve basis and/or based on priority information. As such, the performance request from the mobile terminal may be added to the performance schedule (block 640).

Using the wireless connection, a user of the mobile terminal may perform karaoke (block 645). More specifically, once a song selection has been made and a performance slot has been requested, the server sends an alert/notification (NOTIFY) 646 to the mobile terminal associated with the next performance request. If multiple performers are scheduled to perform together, the notification 646 may be transmitted to multiple mobile terminals that are associated with the scheduled performers. However, if a performer is schedule to perform a sequential group of songs, no notification may be transmitted. Once the notification is received, the karaoke server provides a signal (SETUP AUDIO STREAM) 647 to the mobile terminal to set up an audio stream, and the mobile terminal transmits a message (READY) 648 to the server indicating that it is ready to transmit. The karaoke server may also transmit a series of countdown messages (COUNTDOWN) 649 to the mobile terminal. If lyrics are to be displayed on the mobile terminal, the karaoke server may send them one screen at a time, synchronized with the music. The karaoke server then cues the song specified in the performance request and receives voice data from the mobile terminal via the audio stream (AUDIO STREAM) 651. Depending on the functionality of the karaoke server, the received voice data may be mixed and/or processed at the karaoke server, or alternatively, may be routed to a karaoke machine for output. The karaoke server sends a message (CLOSE STREAM) 652 to the mobile terminal to close the audio stream at the end of the selected song(s). As such, a karaoke performance may be provided via a mobile terminal (block 655).

The mobile terminal may also request to end the connection (block 656) by transmitting a request (REQ) 657 to the karaoke server. The karaoke server transmits a response (GRANT) 659 to grant the request, thereby ending the wireless data connection with the mobile terminal (block 660).

Accordingly, in some embodiments of the present invention, a karaoke service may be provided using audio data received from a mobile terminal. More particularly, a mobile terminal may be operated in conjunction with a karaoke server to request a performance slot in a karaoke performance schedule, view available songs and/or scheduled performers, and/or perform a song. As such, many of the problems encountered in conventional karaoke establishments relating to scheduling and performing karaoke may be overcome.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A method of operating a karaoke server to provide a karaoke service, the method comprising:

receiving a plurality of performance requests associated with a plurality of mobile terminals;

queuing the plurality of performance requests in a selected order to provide a karaoke performance schedule;

receiving a performance schedule query from one of the plurality of mobile terminals;

transmitting at least a portion of the karaoke performance schedule to the querying mobile terminal responsive to receiving the performance schedule query;

identifying a next performance request based on the karaoke performance schedule;

determining an end time of a current karaoke performance;

transmitting a notification to one of the plurality of mobile terminals associated with the next performance request over a wireless connection at a predetermined time based on the determined end time;

receiving audio data from the mobile terminal associated with the next performance request over a wireless connection responsive to transmitting the notification thereto; and providing the received audio data to audio equipment for output.

2. The method of claim 1, wherein the received audio data comprises first audio data, the method further comprising:

retrieving second audio data associated with the first audio data from a database; and mixing the first audio data and the second audio data;

wherein providing the received audio data comprises providing the mixed audio data.

3. The method of claim 2, wherein the database comprises a song database, wherein the first audio data comprises voice data received via a microphone of the mobile terminal associated with the next performance request, and wherein the second audio data comprises instrumental music data corresponding to a song specified in the next performance request and retrieved from the song database.

4. The method of claim 3, further comprising:

retrieving lyric data corresponding to the song specified in the next performance request from the song database; and transmitting the lyric data to a display of the mobile terminal associated with the next performance request.

5. The method of claim 1, wherein receiving the plurality of performance requests, queuing the plurality of performance requests, identifying the next performance request, determining the end time, transmitting the notification, and receiving the audio data are performed by a karaoke server, wherein the audio data comprises voice data, and wherein providing the received audio data comprises providing the received voice data from the karaoke server to a karaoke machine.

6. The method of claim 1, further comprising:

receiving a song database query from a mobile terminal; and transmitting a list of song library information to the querying mobile terminal responsive to receiving the song database query.

7. The method of claim 1, wherein queuing the plurality of performance requests in the selected order comprises:

queuing the plurality of performance requests based on an order of receipt thereof to provide the karaoke performance schedule.

8. The method of claim 1, wherein queuing the plurality of performance requests in the selected order comprises:

queuing the plurality of performance requests based on respective priority data associated with the plurality of mobile terminals to provide the karaoke performance schedule.

9. The method of claim 1, further comprising:

receiving a plurality of manually entered performance requests that are not associated with the plurality of mobile terminals; and wherein queuing comprises queuing the plurality of manually entered performance requests and the plurality of performance requests associated with the mobile terminals together in a selected order to provide the karaoke performance schedule.

10. The method of claim 1, further comprising:

rescheduling the next performance request in the performance schedule if audio data is not received from the mobile terminal associated with the next performance request responsive to transmitting the notification thereto.

11. The method of claim 1, wherein queuing the plurality of performance requests comprises:

assigning the plurality of performance requests to respective designated timeslots in the karaoke performance schedule; and wherein transmitting a notification comprises transmitting the notification to the mobile terminal associated with the next performance request at a predetermined time based on a designated timeslot associated with the performance request therefrom, and wherein receiving audio data comprises receiving the audio data from the mobile terminal associated with the next performance request during the designated timeslot.

12. The method of claim 1, further comprising:

receiving a user request to perform karaoke at a user interface associated with one of the plurality of mobile terminals;

formatting the user request at the mobile terminal associated with the user interface to provide a performance request configured to be queued at a karaoke server;

transmitting the performance request from the mobile terminal associated with the user interface to the karaoke server over a wireless connection;

receiving the notification at the mobile terminal associated with the user interface from the karaoke server over a wireless connection at the predetermined time; and transmitting audio data from the mobile terminal associated with the user interface to the karaoke server over a wireless connection responsive to receiving the notification.

13. The method of claim 1, wherein the mobile terminal associated with the next performance request comprises a plurality of mobile terminals.

14. A computer program product for providing a karaoke service, the computer program product comprising a computer readable storage medium having computer readable program code embodied therein configured to carry out the method of claim 1.

15. A method of operating a mobile terminal to provide a karaoke service, the method comprising:

receiving a user request to perform karaoke for a specified song from a user interface of the mobile terminal;

formatting the user request to provide a performance request configured to be queued at a karaoke server;

transmitting the performance request to the karaoke server over a first wireless connection;

receiving a notification from the karaoke server over a second wireless connection at a predetermined time based on an end time of a current karaoke performance;

transmitting audio data to the karaoke server over a third wireless connection responsive to receiving the notification therefrom;

receiving a user request to view a performance schedule from the user interface;

transmitting a performance schedule query to the karaoke server responsive to receiving the user request to view the performance schedule;

receiving at least a portion of the karaoke performance schedule from the karaoke server responsive to transmitting the performance schedule query thereto; and displaying the at least a portion of the karaoke performance schedule on a display of the mobile terminal.

16. The method of claim 15, wherein the first, second, and/or third wireless connection is provided over an ad hoc wireless network, and further comprising:

receiving voice data corresponding to the specified song via a microphone of the mobile terminal; and wherein transmitting audio data comprises transmitting the received voice data to the karaoke server.

17. The method of claim 16, further comprising:

receiving lyric data corresponding to the specified song from the karaoke server over the wireless connection; and displaying the lyric data on a display of the mobile terminal.

18. The method of claim 15, further comprising:

receiving a user request to view a list of song library information from the user interface;

transmitting a song database query to the karaoke server responsive to receiving the user request to view the song library information; and receiving the list of song library information from the karaoke server responsive to transmitting the song database query thereto; and displaying the list of song library information on a display of the mobile terminal.

19. The method of claim 15, wherein the first, second, and/or third wireless connections comprise a same wireless connection.

20. A mobile terminal configured to carry out the method of claim 15.

21. A computer program product for operating a mobile terminal to provide a karaoke service, the computer program product comprising a computer readable storage medium having computer readable program code embodied therein configured to carry out the method of claim 15.

22. A karaoke server, comprising:

a first interface configured to receive a plurality of performance requests associated with a plurality of mobile terminals;

a second interface configured to receive performance schedule query requests associated with the plurality of mobile terminals;

a transceiver configured to establish wireless connections with the plurality of mobile terminals; and a controller coupled to the first and second interfaces and the transceiver and configured to queue the received plurality of performance requests in a selected order to provide a karaoke performance schedule, identify a next performance request based on the karaoke performance schedule, and determine an end time of a current karaoke performance, wherein the controller is further configured to provide a notification to a mobile terminal associated with the next performance request over a wireless connection at a predetermined time based on the determined end time, receive audio data from the mobile terminal over a wireless connection responsive to transmission of the notification, and provide the received audio data to audio equipment for output, and wherein the controller is further configured to provide at least a portion of the karaoke performance schedule to the mobile terminals associated with received performance schedule query requests.

23. The karaoke server of claim 22, wherein the audio data comprises first audio data, and further comprising:

a database coupled to the controller and configured to store second audio data associated with the first audio data; and an audio processor coupled to the controller;

wherein the controller is configured to retrieve the second audio data from the database and provide the first and second audio data to the audio processor, and wherein the audio processor is configured to mix the first audio data and the second audio data and provide the mixed audio data to a speaker for output.

24. The karaoke server of claim 23, wherein the database comprises a song database, wherein the first audio data comprises voice data received via a microphone of the mobile terminal associated with the next performance request, and wherein the second audio data comprises instrumental music data corresponding to a song specified in the performance request.

25. The karaoke server of claim 24, wherein the controller is further configured to retrieve lyric data corresponding to the song specified in the performance request from the song database and provide the lyric data to a display of the mobile terminal associated with the next performance request.

* * * * *